US006399907B1

(12) United States Patent
Eisenhower, Jr. et al.

(10) Patent No.: US 6,399,907 B1
(45) Date of Patent: Jun. 4, 2002

(54) HELICAL COIL SWITCH CONTACT ASSEMBLY

(75) Inventors: Gary W. Eisenhower, Jr.; David E. Olsen, both of Freeport; Jeffrey S. Hall, Winnebago, all of IL (US)

(73) Assignee: Honeywell International INC., Morristown, NJ (US)

( * ) Notice: Subject to any disclaimer, the term of this patent is extended or adjusted under 35 U.S.C. 154(b) by 0 days.

(21) Appl. No.: 09/881,247

(22) Filed: Jun. 13, 2001

(51) Int. Cl.[7] ..... H01H 1/06
(52) U.S. Cl. ..... 200/243; 200/540; 200/276.1
(58) Field of Search ..... 200/276, 276.1, 200/243, 447, 448, 540

(56) References Cited

U.S. PATENT DOCUMENTS

RE15,152 E * 7/1921 Krantz ..... 200/447
1,709,947 A * 4/1929 Frantl ..... 200/276 X
2,487,922 A * 11/1949 DeChant et al. ..... 200/276 X
4,473,727 A * 9/1984 Beck ..... 200/276 X
5,569,890 A * 10/1996 Olsen ..... 200/448 X

FOREIGN PATENT DOCUMENTS

GB 2042271 * 9/1980 ..... 200/243 X

* cited by examiner

*Primary Examiner*—Renee Luebke
(74) *Attorney, Agent, or Firm*—Anthony Miologos

(57) ABSTRACT

An electrical contact assembly is disclosed comprising a bracket having at least first and second cavities located on opposite ends of the bracket and an opening extending through the bracket between the first and second cavities. A retention member is arranged to be mounted within the bracket opening with a first portion of the retention member extending outward from the first cavity and a second portion of the retention member extending outward from the second cavity. Each first and second portion terminates in a head end. First and second helix-shaped electrical contacts are positioned about a respective retention member first and second portion and are compressively retained between a respective and associated head end and bracket cavity.

30 Claims, 4 Drawing Sheets

HELICAL COIL SWITCH CONTACT ASSEMBLY

BACKGROUND OF THE INVENTION

1. Field of the Invention

The present invention relates generally to electro-mechanical switch contacts and, more specifically, to an electrical contact assembly having helical coil contact structures.

2. Discussion of the Related Art

Industrial limit switches, such as global limit switches, safety interlocks, safety solenoid interlocks and cable pull limit switches are used in a variety of industrial applications. Limit switches contain switches that are manufactured to suit the particular application.

Typically, switches used in these products are designed and manufactured for a particular contact arrangement. Such switches generally contain two or more circuits having one or more normally closed (NC) contacts and/or one or more normally open (NO) contacts. Conventional arrangements typically include one normally open/one normally closed, also called a "single pole" arrangement, or two normally open/two normally closed, also called a "double pole" arrangement. Conventional industrial limit switches often require additional normally closed contacts for added redundancy. Limit switch applications often require at least three positively driven, normally closed contacts along with one normally open monitor circuit.

U.S. Pat. No. 6,114,639, assigned to the assignee of the present invention, teaches a configurable switch having a configurable base and a configurable plunger, which together permit the adjustable arrangement of contacts into several electrical switching configurations. Within such a switch, one or more movable contacts are mounted to a plunger that is movable between a first position and a second position. In the first position or the second position, the movable contacts make contact and/or break contact with respective stationary contacts, depending upon the arrangements of the stationary contacts and the movable contacts. The movable contacts shown and typically used in such switch configurations are constructed from conductive material with each including two contact pads spaced at a distance from each other and connected by a contact bracket. The contact pads are each preferably composed of a fine silver disk or other suitable conductive material welded or otherwise attached to the movable contact. The contact bracket of each movable contact is mounted within a respective opening of the movable plunger and biased by a spring, thereby positioning the associated contact pads either apart from a respective stationary contact or engaged to the stationary contact, forming either a make or a break switching arrangement.

When such an electro-mechanical switch is used in low energy applications, typically those in the 24 volt, 2–10 milliamp range, other more-conductive materials or contact structures are used in order to enhance continuity and reliability. For example, gold plating may be deposited on a serrated contact, a bifurcated contact can be substituted for the contact pad, or a knife-edge shaped contact using a gold-inlay material substituted for the contact pads.

All of these material and structural substitutions, however, over the course of many switching operations, eventually fail in maintaining continuity, causing the low energy switch to fail. For example, gold-plating, deposited typically at a thickness of 0.0001 to 0.0002 inches, tends to wear off over the life of the contact. Serrated contacts attract contaminants from within the switch, which contaminants become trapped as the serrations degrade. Gold-inlay, which is very soft and ductile, also degrades over many mechanical operations of the contacts due to the "hammering" effect imparted by the mechanical closure of the contacts. Gold-plated bifurcated contacts, even though providing a somewhat more reliable contact, due primarily to its plural points of electrical contact, also eventually suffers from wear imparted by the hammering effect and contact bounce. Contact bounce in such switching contacts can lead to equipment malfunctions due to the fast response time of the industrial equipment being controlled.

Therefore, reliability of operation is important in such low-energy switching devices since these devices are extensively used in safety relay and safety control applications in industry. A marginally-operating or failed switch can have economic as well as catastrophic consequences to an industrial process if the devices fail to operate correctly.

BRIEF SUMMARY OF THE INVENTION

It is, therefore, an object of the present invention to provide an improved electrical switch contact.

It is also an object of the present invention to provide an electrical switch contact assembly that increases the level of continuity in low-energy switch applications.

It is also a further object of the present invention to provide an improved switching contact assembly that minimizes contact bounce.

Therefore, there is provided in a first embodiment of the present invention, an electrical contact assembly comprising a bracket having at least a first and a second cavity located on opposite ends of the bracket and an opening extending through the bracket between the first cavity and said second cavity. The electrical contact assembly further includes an electrically conductive retention member mounted within the bracket opening having a first tubular portion extending outward from the first cavity, terminating in a first annular flange. A second tubular portion extends outward from the second cavity, also terminating in a second annular flange. The said first and said second flanges have a diameter greater than their respective and associated retention member first and second portions. A first coiled electrical contact is positioned about and compressively retained on the retention member first portion between the first annular flange and the bracket first cavity. A second coiled electrical contact is also positioned about and compressively retained on the retention member second portion, between the second annular flange and the bracket second cavity.

In a second embodiment of the present invention there is provided an electrical contact assembly comprising a bracket having at least a first and a second cavity located on opposite ends of the bracket and an opening extending through the bracket between the said first cavity and said second cavity. An electrically conductive retention member is mounted within the bracket opening and includes a first portion having first and second arms, oriented in a parallel and spaced relationship to the other, extending outward from the first cavity. A second portion, also having first and second arms, oriented in a parallel and spaced relationship to the other, extends outward from the second cavity. Each first and second arm of the first and second portions terminates in a wedge-shaped structure that extends perpendicularly from its associated arm, thereby forming a shoulder member having a width greater than the width of the first and second portions respectively. The electrical contact assembly further includes a first coiled electrical contact positioned about and compressively retained on the retention member first portion, between its associated shoulder member and the bracket first cavity and a second coiled electrical contact positioned about and compressively retained on the retention member second portion, between its associated shoulder member and the bracket second cavity.

BRIEF DESCRIPTION OF THE SEVERAL VIEWS OF THE DRAWINGS

Other objects, features, and advantages of the present invention will be apparent from the following description of a preferred embodiment thereof, taken in conjunction with the sheets of drawings, in which.

DETAILED DESCRIPTION OF THE INVENTION

Figure 1:
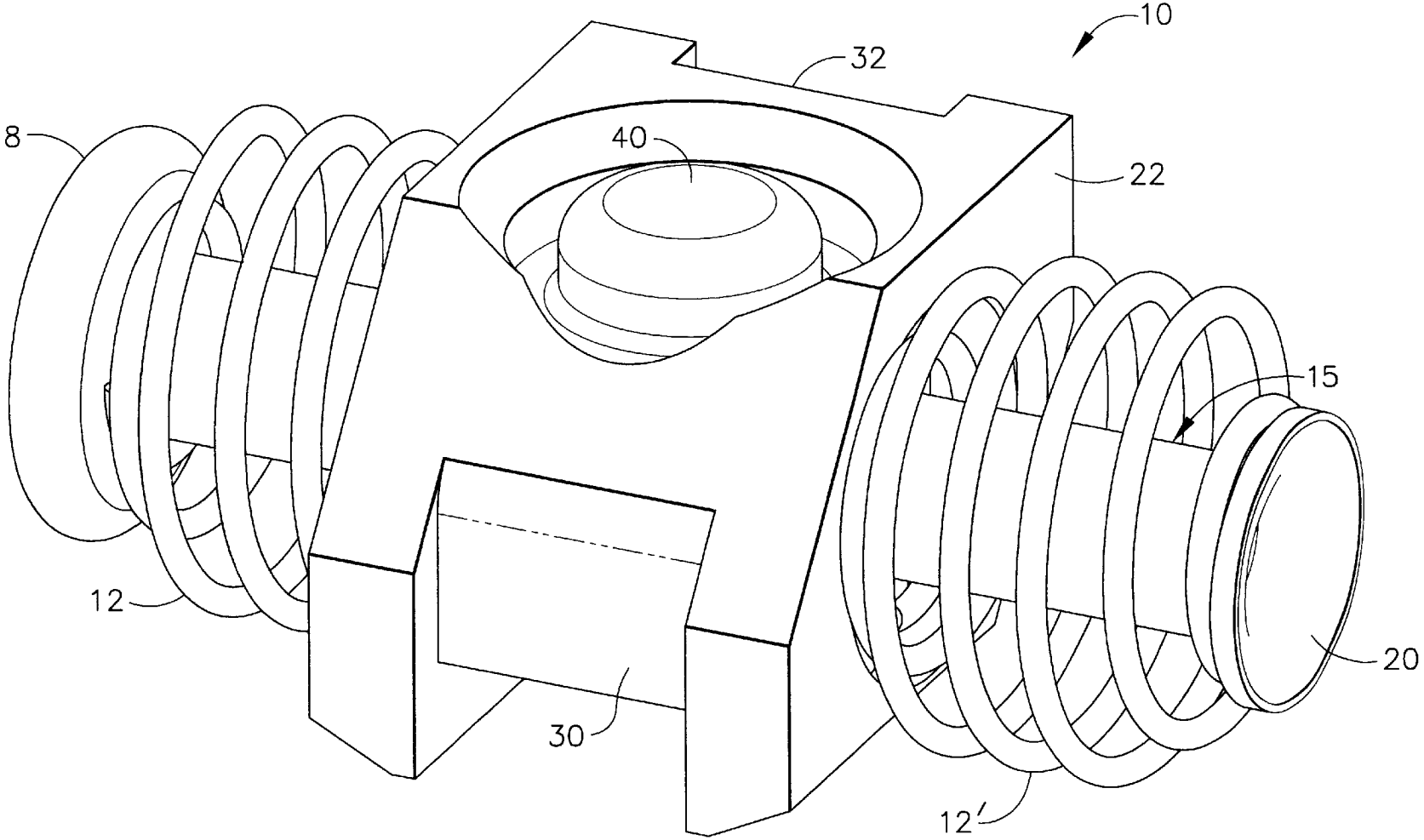
FIG. 1 is a perspective view of a first embodiment of the helical coil switch contact assembly in accordance to the present invention.
Figure 2:
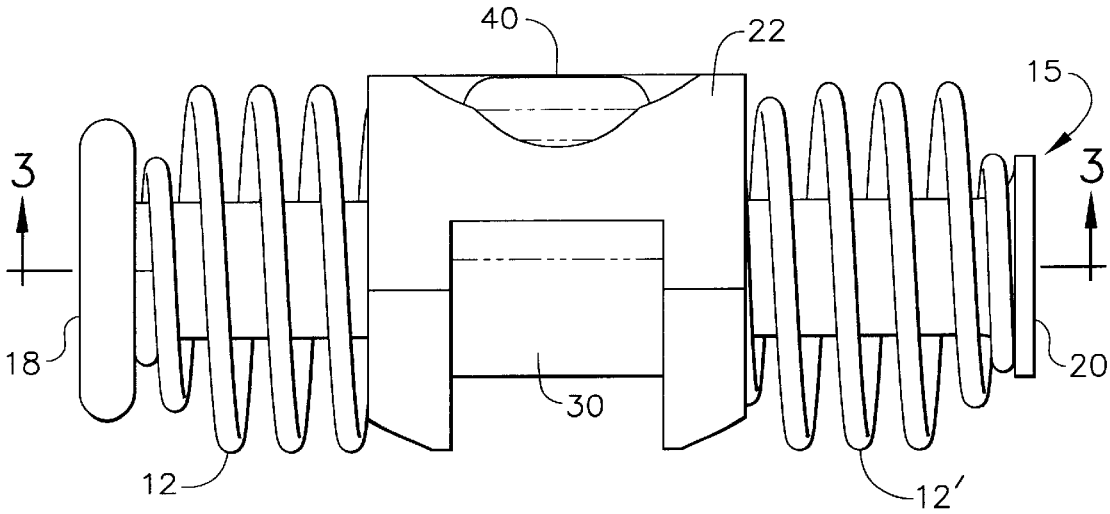
FIG. 2 is an elevational view of a first embodiment of the helical coil switch contact assembly of the present invention.
Figure 3:
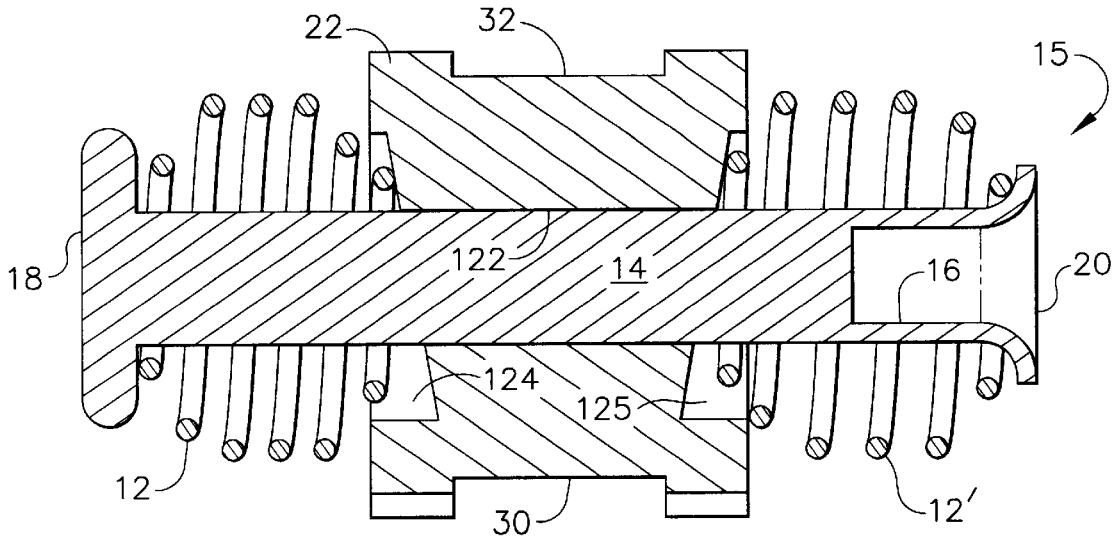
FIG. 3 is a sectional view taken along line 3—3 of FIG. 2.

FIGS. 1, 2 and 3 show the helical coil switch contact assembly according to one preferred embodiment of the present invention. The assembly is comprised of two barrel-shaped helical coil spring contacts 12 and 12' held in compression about an electrically conductive retention device 15 between first and second head ends 18 and 20 of the retention device 15 and a contact bracket 22. Each coil spring contact 12 and 12' is composed of a good electrically conductive material. Typically, this material would be copper-based and may also be gold-plated to improve its electrical conductivity.

As was previously mentioned, the helical coil switch contact assembly 10 of the present invention may be used to advantage in the configurable switch assembly of U.S. Pat. No. 6,114,639, assigned to the assignee of the present invention and which is incorporated herein by reference. The helical coil switch contact assembly of the present invention can be used in place of the movable contacts shown in the reference. However, it will be well understood by those skilled in the art that the helical coil switch contact assembly 10 of the present invention can also be used in other electrical contact switching applications and is not limited for use with the configurable switching devices shown by U.S. Pat. No. 6,114,639.

Each coil of each coil spring contact 12 and 12' provides a contact surface for engagement with an associated stationary contact surface (not shown). As can be seen in FIGS. 1–3, each coil spring contact 12, 12' groups together a contact structure having four contact surfaces or contact points that as a group is disposed to mechanically engage an associated stationary contact. It will be appreciated by those skilled in the art that even though the present invention is shown with each coil spring contact 12, 12' having four coil turns, any number of individual coil turns may be used to form each coil spring contact 12 and 12' and, therefore, the invention is not limited thereto.

Further, each coil spring contact 12, 12' is barrel-shaped, that is, the coil turns at the center of each coil spring contact are larger in diameter than the coil turns at each end. This particular form has advantage over a non-barrel or straight coil springs in that it compensates for imperfections and/or lack of flatness with the associated stationary contact (not shown) and also tends to "wipe" across the stationary contact surface upon engagement, thereby minimizing the effects of contact bounce.

As can best be seen in FIGS. 2 and 3, each coil spring contact 12, 12' is mounted about separate portions of the retention member 15. Retention member 15 is comprised of a single monolithic pin member having a tubular body 14 that terminates on a first end in an annular head 18 having a diameter greater than the diameter of the tubular body 14. A second and opposite end of tubular body 14 terminates in a cavity 16 extending from the second end of tubular body 14 longitudinally within its interior. Retention member 15 is composed of a good electrically conductive material such as any copper-based material or the like and may also be gold-plated to improve its electrical conductivity. The retention member 15 may also be made using a standard commercially available rivet fastener of an appropriate dimension that has good electrical conductivity properties.

The retention member 15 is held within a molded plastic contact bracket 22. A through-hole 122 extends through the contact bracket 22 and is arranged to receive therethrough and retain therein, tubular body 14 of retention member 15. As can be best seen in FIG. 3, coil spring contact 12 is installed on body 14 and held in slight compression between head end 18 and mating surface 124 of contact bracket 22. Similarly, coil spring contact 12' is installed over body 14 and held in slight compression between head end 20 and a mating surface 125 of the contact bracket 22. Mating surfaces 124 and 125 are molded at a slight angle with respect to the center plane of each coil spring contact 12,12', creating a linear imbalance in each coil spring contact. Over continued actuation of a switch mechanism employing the contact assembly 10 each coil spring contact 12 and 12' will rotate about retention member 15, thus presenting a new contact surface throughout the life of the contact assembly 10.

Figure 5:
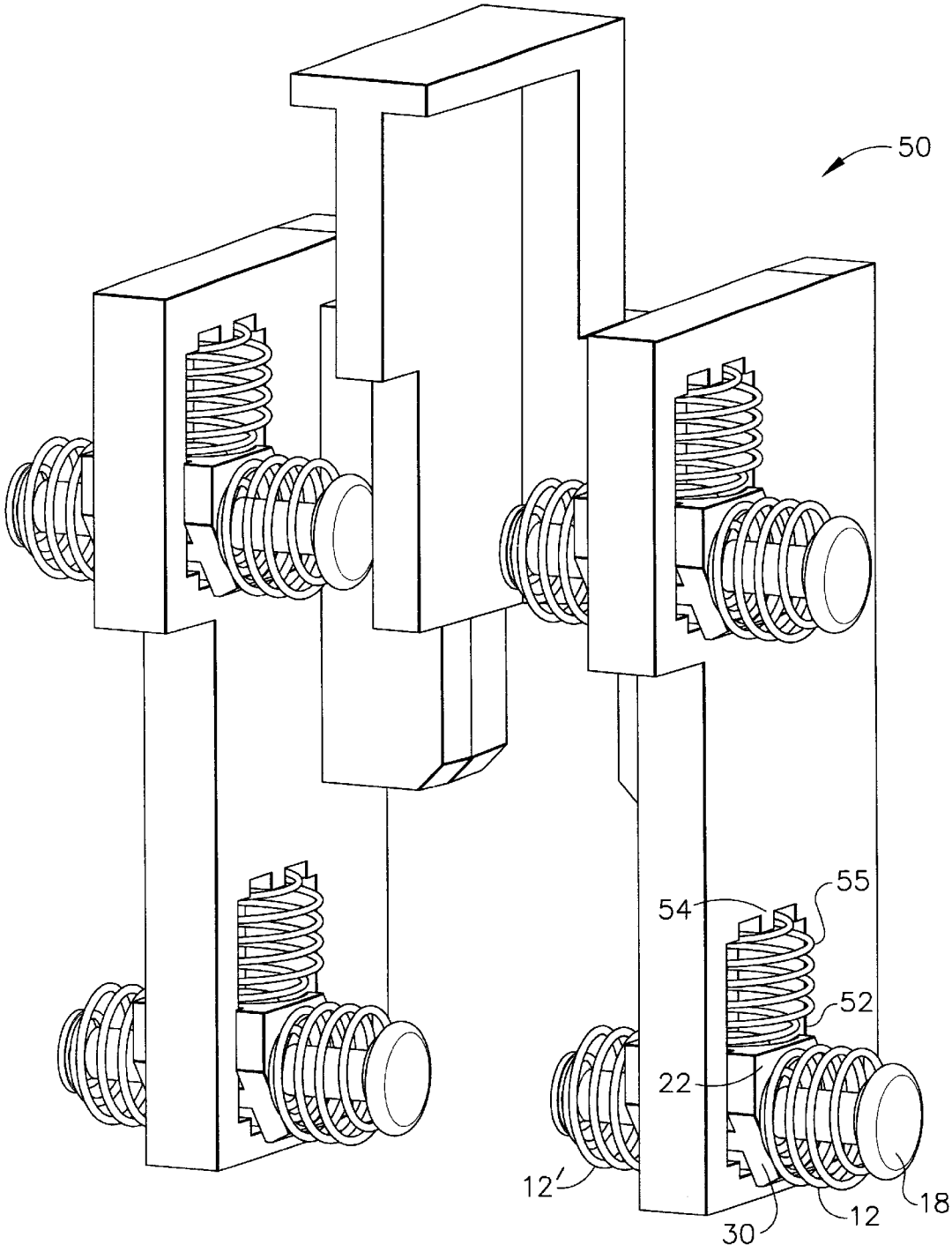
FIG. 5 is a perspective view of a switch plunger having the movable contacts of the present invention mounted thereon.

The contact bracket 22 further includes cutout portions 30 and 32 formed on the front and back surfaces of the contact bracket 22 respectively and a biasing element retainer cavity 40 formed on the contact bracket 22 top surface. These aforementioned structures are used to advantage in the mounting of the contact assembly 10 within a switch plunger, such as switch plunger 50 in FIG. 5. Cutouts 30 and 32 are arranged to closely engage with opening 52 of switch plunger 50 and thus restrict unwanted movement of the contact assembly 10 within switch plunger 50. The contact assembly 10 is mounted within opening 52 preferably with a bias element, such as bias spring 55, positioned within each opening 52. Spring 55 urges the contact assembly 10 toward a stop or edge surface of plunger 50 adjacent opening 52. One end of bias spring 55 is arranged to be set within cavity 40 of the contact bracket 22 with a second and opposite end of biasing spring 55 engaging surface 54 of opening 52. Each contact assembly 10 is displaceable within the limits allowed by cavity 52 and functions in a manner similar to the movable contacts shown in U.S. Pat. No. 6,114,639.

The aforementioned contact assembly 10 of FIGS. 1–3 is assembled by passing coil spring contact 12 over the second end of tubular body 14 to rest against an inside surface of head end 18. Next, the second end of tubular body 14 is inserted into through-hole 122 of contact bracket 22 until coil spring contact 12 compresses slightly between head end 18 and mating surface 124. Next coil spring contact 12' is passed over the second end of tubular body 14 until it rests on mating surface 125 of contact bracket 22. The assembly is completed by cold forming head end 20. The cold forming is accomplished by the use of a tool (not shown) that includes a bit that is inserted into cavity 16. Sufficient pressure is applied by the tool to the tubular body cavity 16 to turn aside and slightly outward the peripheral edges of the cavity, thereby permanently forming the structure shown in FIG. 3 as head end 20. As can be seen in FIG. 3, after the cold forming step, head end 20 forms a generally annular structure having a diameter greater than the tubular body 14 and that slightly compresses coil spring contact 12' between head end 20 and mating surface 125.

Figure 4:
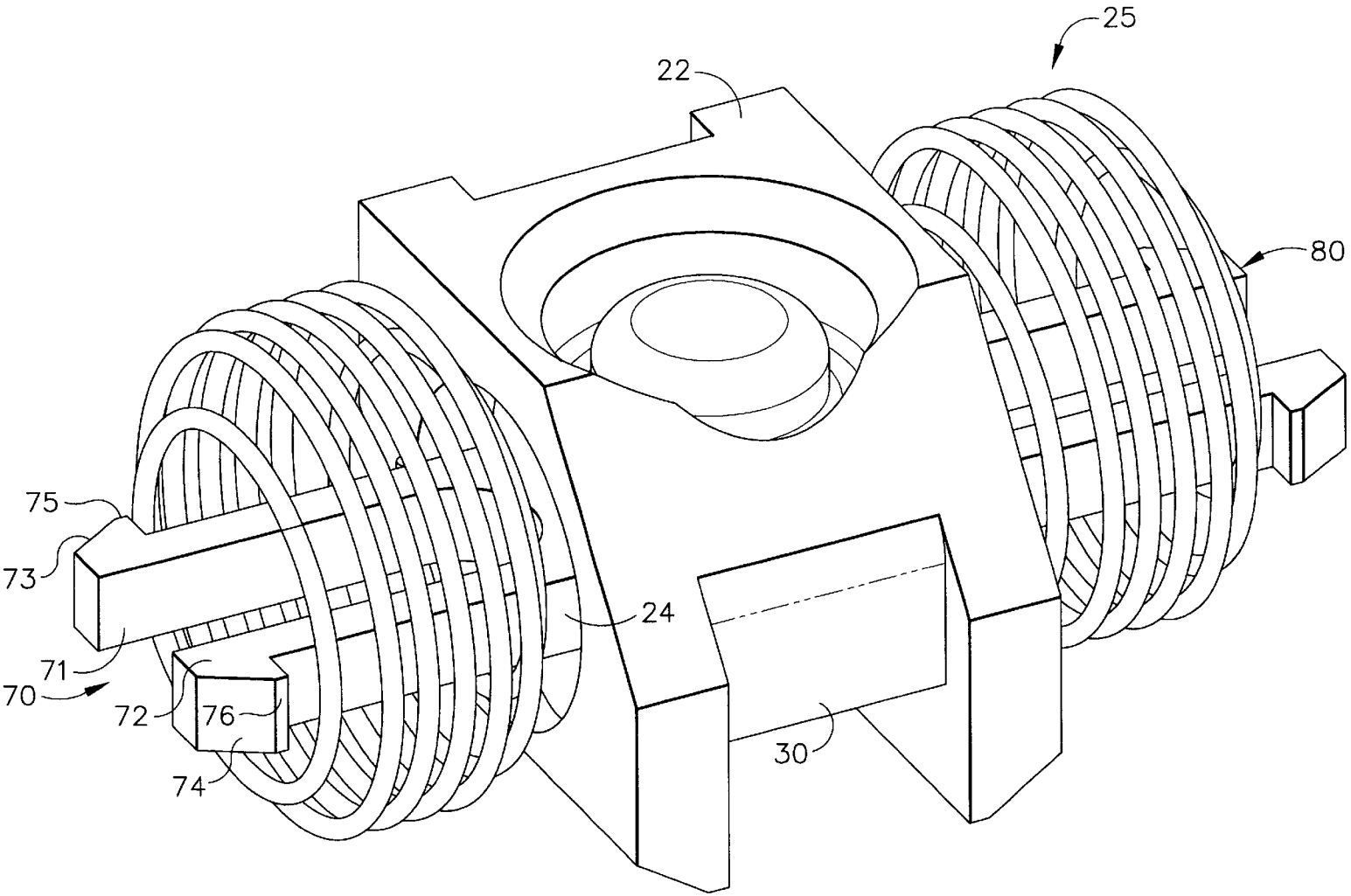
FIG. 4 is a perspective view of a second embodiment of the helical coil switch contact assembly in accordance to the present invention.

Turning now to FIG. 4 of the included drawings, a second preferred embodiment of the helical coil switch contact assembly 10 of the present invention is shown. As will be appreciated by those skilled in the art, the assembly procedure of the helical coil contact assembly 10 of FIG. 1 requires an ordered step process in its assembly. The helical coil switch contact 10 of this second preferred embodiment simplifies its assembly.

In this second embodiment of the present invention, the retention member 25 is comprised of a flat, generally rectangular shaped, stamped body 24 that is arranged to be accepted within through-hole 122 of contact bracket 22. The flat body 24 has a transverse dimension or width that is substantially the same dimension as the diameter of through-hole 122. As will be appreciated by those skilled in the art, with the flat body width at substantially the same dimension as the diameter of the through-hole 122, the longitudinal center axis of flat body 24 will be located along and concentric with the center axis of through-hole 122 when the flat body 24 is installed therein. As will also be appreciated, the concentric association between the longitudinal center axis of flat body 24 and the center axis of through-hole 122 is maintained as the flat body 24 is rotated along its longitudinal axis during the operation of the contact assembly 10.

With renewed reference to FIG. 4, the portions of the flat body 24 extending outward from mating surfaces 124 and 125 are formed into two sets of double arms 70 and 80 respectively. Arm-set 70 is comprised of arms 71 and 72 extending from a first end in a spaced and parallel relationship to each other from flat body 24. A second and opposite end of each arm 71 and 72 terminates in a wedge-shaped head structure 73 and 74 respectively. Coil spring contact 12 is supported by arms 71 and 72 and held in slight compression between mating surface 124 of contact bracket 22 and shoulders 75, 76 of head structures 73, 74 respectively. Arm-set 80 includes the same structures described for arm-set 70 and supports and holds coil spring contact 12' in the same manner as explained for coil spring contact 12.

The coil spring contact assembly 10 is assembled in this second embodiment by first installing the retention member 25 flat body 24 within through-hole 122 of the contact bracket 22. Coil spring contact 12 is installed on the retention member 25 by deflecting arms 71 and 72 toward each other, allowing coil spring contact 12 to be passed over head structures 72 and 73 until a first end of the contact 12 engages mating surface 124. The coil spring contact 12 is compressed toward contact bracket 22 and arms 71 and 72 are allowed to return to their un-deflected positions. When the compression force is released from coil spring contact 12, the contact attempts to return to its uncompressed state, however, it is held in slight compression by the engagement of the contact 12 second end with shoulders 75 and 76 of head structures 73 and 74. Coil spring contact 12' is assembled on arm-set 80 in the same manner as previously explained for coil spring contact 12. The flat body 24 and arm-sets 70 and 80, forming the retention member 25 of this second embodiment, are constructed as an integral structure from a good electrically conductive material such as any copper-based material or the like and gold-plated to improve its electrical conductivity.

The present invention has been described with particular reference to the preferred embodiments thereof. It will be obvious that various changes and modifications can be made therein without departing from the spirit and scope of the invention as defined in the appended claims.

What is claimed is:

1. An electrical contact assembly comprising:

a bracket having at least first and second surfaces and an opening extending through said bracket between said first and second surfaces;

a retention member mounted within said bracket opening having at least a first portion extending outward from said first surface and terminating in a first head end; and at least a first helix-shaped electrical contact positioned about said retention member first portion, compressively retained between said first head end and said bracket first surface.

2. The electrical contact assembly as claimed in claim 1 wherein said retention member further includes a second portion extending outward from said bracket second surface and terminating in a second head end, and said electrical contact assembly further includes a second helix-shaped electrical contact positioned about said retention member second portion compressively retained between said second head end and said bracket second surface.

3. The electrical contact assembly as claimed in claim 2 wherein said retention member first and second portions are generally tubular in cross section having a diameter that is acceptable within said bracket opening, and said first head end is an annular flange integrally fixed to one end of said first portion, said head end having a diameter greater than the diameter of said first portion.

4. The electrical contact assembly as claimed in claim 3 wherein said retention member second portion includes a cavity and an outer peripheral edge surface surrounding said cavity, whereby said second head end is formed by inserting a tool in said cavity and applying pressure to said cavity peripheral edge, thereby deforming said peripheral edge into an annular flange having a diameter greater than said second portion.

5. The electrical contact assembly as claimed in claim 4 wherein said retention member is composed of an electrically-conductive material.

6. The electrical contact assembly as claimed in claim 5 wherein said retention member is further plated with gold to improve its electrically conductive properties.

7. The electrical contact assembly as claimed in claim 2 wherein each of said first and second helix-shaped electrical contacts is comprised of first and second barrel-shaped coil springs, each of said coil springs having a plurality of coil turns with first and second terminating coil turns having a diameter less than the coil turns at the coil springs' center.

8. The electrical contact assembly as claimed in claim 7 wherein the diameter of each of said first and second coil springs second terminating coil turn is less than the diameter of said retention members first and second head ends, respectively.

9. The electrical contact assembly as claimed in claim 7 wherein said first and second coil springs are composed of an electrically-conductive material.

10. The electrical contact assembly as claimed in claim 9 wherein said first and second coil springs are further plated with gold to improve their electrically conductive properties.

11. The electrical contact assembly as claimed in claim 7 wherein said brackets first and second surfaces is the floor of a respective first and second circular cavity, wherein said first and second cavity floor accepts thereon said first terminating coil of said first and second coil spring respectively.

12. The electrical contact assembly as claimed in claim 11 wherein said floor of each of said first and second cavities is oriented at an angle with respect to the center plane of each respective first and second coil spring.

13. The electrical contact assembly as claimed in claim 7 wherein said retention member is generally planar in cross section and includes a center portion having a width that is acceptable within said bracket opening and each of said first and second portions are comprised of first and second arms oriented in a parallel and spaced relationship to the other extending from opposite ends of said center section, each first and second arm of said first and second portion terminating in a wedge-shaped structure that extends perpendicularly from its associated arm, thereby forming a shoulder member having a width greater than the width of said first and second portions respectively.

14. The electrical contact assembly as claimed in claim 13 wherein the diameter of each of said first and second coil springs second terminating coil turn is less than the width of said first and second retention member shoulder member respectively.

15. The electrical contact assembly as claimed in claim 14 wherein said retention member is composed of an electrically-conductive material.

16. The electrical contact assembly as claimed in claim 15 wherein said retention member is further plated with gold to improve its electrically conductive properties.

17. An electrical contact assembly comprising:

a bracket having at least a first and a second cavity located on opposite ends of said bracket and an opening extending through said bracket between said first cavity and said second cavity;

an electrically-conductive retention member mounted within said bracket opening, having a first tubular portion extending outward from said first cavity, terminating in a first annular flange and a second tubular portion extending outward from said second cavity, terminating in a second annular flange, said first and said second flanges having a diameter greater than their respective and associated first and second portions;

a first coiled electrical contact positioned about and compressively retained on said retention member first portion between said first annular flange and said bracket first cavity; and a second coiled electrical contact positioned about and compressively retained on said retention member second portion between said second annular flange and said bracket second cavity.

18. The electrical contact assembly as claimed in claim 17 wherein each of said first and second coiled electrical contacts is comprised of first and second barrel-shaped coil springs, each of said coil springs having a plurality of coil turns with first and second terminating coil turns having a diameter less than the coil turns at the coil springs' center.

19. The electrical contact assembly as claimed in claim 18 wherein the diameter of each of said first and second coil spring's second terminating coil turn is less than the diameter of said retention member first and second head ends respectively.

20. The electrical contact assembly as claimed in claim 19 wherein each of said bracket's first and second cavities is circular in cross section and further includes a cavity floor, each first and second cavity floor arranged to accept thereon said first terminating coil of said first and second coil spring, respectively.

21. The electrical contact assembly as claimed in claim 20 wherein said floor of each of said first and second cavities is oriented at an angle with respect to the center plane of each respective first and second coil spring.

22. The electrical contact assembly as claimed in claim 17 wherein said retention member is further plated with gold to improve its electrically conductive properties.

23. The electrical contact assembly as claimed in claim 17 wherein said first and second coil springs are further plated with gold to improve their electrically conductive properties.

24. An electrical contact assembly comprising:

a bracket having at least a first and a second cavity located on opposite ends of said bracket and an opening extending through said bracket between said first cavity and said second cavity;

an electrically conductive retention member mounted within said bracket opening, including a first portion having first and second arms oriented in a parallel and spaced relationship to the other extending outward from said first cavity and a second portion having first and second arms oriented in a parallel and spaced relationship to the other extending outward from said second cavity, each first and second arm of said first and second portions terminating in a wedge-shaped structure that extends perpendicularly from its associated arm, thereby forming a shoulder member having a width greater than the width of said first and second portions respectively;

a first coiled electrical contact positioned about and compressively retained on said retention member first portion, between said shoulder member and said bracket first cavity; and a second coiled electrical contact positioned about and compressively retained on said retention member second portion, between said shoulder member and said bracket second cavity.

25. The electrical contact assembly as claimed in claim 24 wherein each of said first and second coiled electrical contacts is comprised of first and second barrel-shaped coil springs, each of said coil springs having a plurality of coil turns with first and second terminating coil turns having a diameter less than the coil turns at the coil springs' center.

26. The electrical contact assembly as claimed in claim 25 wherein the diameter of each of said first and second coil spring's second terminating coil turn is less than the width of said first and second retention member shoulder members, respectively.

27. The electrical contact assembly as claimed in claim 26 wherein each of said bracket's first and second cavities is circular in cross section and further includes a cavity floor, each first and second cavity floor arranged to accept thereon said first terminating coil of said first and second coil spring, respectively.

28. The electrical contact assembly as claimed in claim 27 wherein said floor of each of said first and second cavities is oriented at an angle with respect to the center plane of each respective first and second coil spring.

29. The electrical contact assembly as claimed in claim 24 wherein said retention member is further plated with gold to improve its electrically-conductive properties.

30. The electrical contact assembly as claimed in claim 24 wherein said first and second coil springs are further plated with gold to improve their electrically conductive properties.

* * * * *